United States Patent [19]

Fujino

[11] 4,358,285

[45] Nov. 9, 1982

[54] PAPER FOLDING APPARATUS

[75] Inventor: Hitoshi Fujino, Yokohama, Japan

[73] Assignee: Canon Kabushiki Kaisha, Tokyo, Japan

[21] Appl. No.: 175,525

[22] Filed: Aug. 5, 1980

[30] Foreign Application Priority Data

| | | | |
|---|---|---|---|
| Aug. 16, 1979 | [JP] | Japan | 54-103551 |
| Aug. 16, 1979 | [JP] | Japan | 54-103552 |
| Sep. 17, 1979 | [JP] | Japan | 54-118966 |
| Nov. 8, 1979 | [JP] | Japan | 54-144725 |

[51] Int. Cl.[3] ..... B65H 45/00

[52] U.S. Cl. ..... 493/411; 493/412; 493/415

[58] Field of Search ..... 493/412, 411, 413–415, 493/433, 448

[56] References Cited

U.S. PATENT DOCUMENTS

| | | | |
|---|---|---|---|
| 1,832,556 | 11/1931 | Jensen et al. | 493/415 |
| 3,640,521 | 2/1972 | Hutley | 493/412 X |
| 3,770,264 | 11/1973 | Sturman et al. | 493/413 X |
| 4,095,779 | 6/1978 | Imagi et al. | 493/412 |
| 4,172,592 | 10/1979 | Müeller et al. | 493/413 |

FOREIGN PATENT DOCUMENTS

| | | | |
|---|---|---|---|
| 2344452 | 3/1974 | Fed. Rep. of Germany | 493/411 |
| 55-101551 | 8/1980 | Japan | 493/411 |

*Primary Examiner*—James F. Coan

*Attorney, Agent, or Firm*—Fitzpatrick, Cella, Harper & Scinto

[57] ABSTRACT

A paper folding apparatus has paper supply means capable of continuously supplying paper, a paper supporting table on which the paper supplied by the paper supply means may be piled in folded condition, and paper folding and conveying means disposed at a predetermined angle on the opposite sides of the surface of the paper for folding the paper supplied by said paper supply means into a fold dimension.

2 Claims, 24 Drawing Figures

PAPER FOLDING APPARATUS

BACKGROUND OF THE INVENTION

1. Field of the Invention

This invention relates to a paper folding apparatus for folding paper along perforations and piling the same.

2. Description of the Prior Art

Generally, in a line printer, paper prefolded along perforations and contained in a paper containing box is supplied to a predetermined paper path and printed, and then discharged out of the line printer. The discharged paper is again folded along the initial perforations by a paper folding apparatus and piled.

A conventional paper folding apparatus is shown in FIG. 1 of the accompanying drawings. FIG. 1 includes paper 1 having no other lateral perforations than creases and alternately folded along these lateral perforations, a pair of paper supply rollers 2, a pair of endless conveyor belts 4 passed over a plurality of rollers 3 and disposed so as to form an inverted V-shape, a guide 5 for controlling the fold length of the paper 1, a vertically movable table 6 on which the paper may be piled, and a detector 7 such as a transmitting type photoelectric switch for detecting the folded surface of the paper 1. The detector 7 is attached to an apparatus body (not shown).

Now, when the paper is passed between the supply rollers 2 and folded into several sheets on the table 6 and set as indicated by solid line and then the folding of the paper 1 is started by rotating the supply rollers 2 and the conveyor rollers 4 in predetermined directions by a driving mechanism, not shown, the paper may sometimes assume a condition as indicated by dotted lines immediately after the folding has been started. This seems to be attributable to the fact that even if the paper is disposed at an appropriate fold angle, a sufficient friction force is not sometimes created between the paper 1 and the conveyor belts 4 and the paper is bent short of the lateral perforation $1_1$, and becomes "yielded".

FIG. 2 shows an example of the conventional apparatus using paper 1 having two lateral perforations at other places than creases and alternately folded along the lateral perforation $1_1$ having a crease. This apparatus has an inconvenience that immediately after the folding has been started, the paper 1 is folded at the lateral perforation $1_2$ provided at the unit of page short of the lateral perforation $1_1$ having a crease as indicated by dotted line and thereby causes a phenomenon of so-called "middle fold" or "reverse fold".

In FIGS. 3 to 5, the paper 1 is not initially piled on the table 6 and therefore, the table 6 is stopped at a position whereat the upper surface thereof is detected by the detector 7, and the upper surface provides the folded surface. After the paper 1 has been passed between the supply rollers 2 and set on the table 6, the folding is started.

The paper 1 is fed toward the table 6 by the supply rollers 2 and frictionally conveyed along one of the conveyor belts 4 moved round in the direction of arrow and, as soon as the paper strikes against the length controlling guide 5, it is folded along a perforation. Subsequently, the paper 1 is alternately folded at the left and right sides thereof so that it is frictionally conveyed along the other conveyor belt 4, and piled. When the folded surface is upwardly displaced due to the increased amount of pile, this displacement is detected by the detector 7 and the table 6 is lowered so as to ensure the folded surface to be always positioned at a predetermined distance from the supply rollers 2.

However, the use of the above-described conventional holding apparatus has not always resulted in good folding. One reason would be that the paper subjected to various operations in the line printer has its creases extended and it is difficult to fold the paper along the creases when it is to be folded again. Another reason is that even if the type of paper is changed, the paper folding level is always fixed and the folding corresponding to the so-called rigidity or strength peculiar to the paper is not effected.

Usually, there are six types of paper usable with the line printer, and according to JIS, they are #45, #55, #70, #90, #110 and #135. For the conventional paper folding apparatus which is designed to use exclusively the paper of quality #70, for example, among the various qualities of paper and in which the folding level is fixed, the thin paper of quality #45 or the paper of quality #110 or higher is too low or too high in rigidity or strength and it has been difficult to fold such paper well.

However, when the detector which detects the folded surface of the paper corresponding to the folding level in the conventional paper folding apparatus has been removed and the folded surface has been moved up and down, it has been found that good folding can be obtained depending on a certain position. Also, it has empirically been confirmed that the aforementioned six qualities of paper respectively have a range of folding level which enables good folding and especially, the ranges of #45 paper and #135 paper do not overlap each other. Further, the paper of #45 and #70 and the paper of #90 and #135 overlap each other in the range of folding level and therefore, at least two folding levels must be set for these qualities of paper.

Referring to FIGS. 6 and 7, there has recently been the advent of a non-impact type printer utilizing a composite technique comprising a combination of the laser light modulating technique and the electrophotographic technique, and in paper discharged from such printer, not only the creases pre-formed at the perforations disappear due to the paper being subjected to a heat treatment within the printer, but also the rigidity or strength of the paper is varied due to the paper being discharged while being hot and thus, it has been difficult to fold such paper.

The conventional paper folding apparatus, as is shown in FIG. 6, comprises a pair of paper supply rollers 2, a pair of endless conveyor belts 4 passed over a plurality of rollers 3 and disposed so as to form an inverted V-shape in which the belts are inclined at a predetermined angle with respect to the surface of paper fed in, a guide 5 for controlling the folded length of the paper 1, a paper supporting table 6, a detector 7 for detecting the folded surface of the paper 1, and a lift mechanism 8 for moving up and down the paper supporting table 6 in accordance with the output of the detector 7. Although not shown in detail, the lift mechanism 8 is provided with a rotating mechanism having its directions of normal and reverse rotation and speed of rotation controlled on the basis of the output of the detector 7, and a nut or the like threadably engaged with a screw rod 10 extending from the underside of the table 6, the nut or the like being driven by said rotating mechanism.

Initially, the paper 1 is not piled on the table 6 and therefore, the table 6 is stopped at a position whereat the upper surface thereof is detected by the detector 7, and the upper surface provides the folded surface. Then, the paper 1 is passed between the supply rollers 2 and folded into several sheets and set on the table 6, whereafter folding of the paper 1 is started by rotating the supply rollers 2 and the conveyer belts 4 in predetermined directions by a driving mechanism, not shown.

The paper 1 is fed in toward the table 6 by the supply rollers 2 and moves from a condition a to conditions b and c in succession as indicated by dots-and-dash lines, and is frictionally conveyed while bearing against the left conveyor belt 4. The paper 1 further moves to a condition d and then to a condition e, and strikes against the length controlling guide 5, whereupon the paper is folded along a perforation. Subsequently, the paper 1 is moved toward the right conveyor belt 4. This is repeated, so that the paper 1 is alternately folded at the left and right side and piled on the table.

However, when an unshown printer to which the abovedescribed paper folding apparatus is attached stops printing and the paper 1 is stopped in the condition d indicated in FIG. 6, the paper 1 subjected to a heat treatment at a high temperature within the printer is suddenly cooled and comes to have a strong curl having a small curvature. Therefore, if the printer again starts printing with the paper remaining in this condition and the paper 1 is fed in by the supply rollers, the paper 1 which has a curvature f as shown in FIG. 7 cannot be folded by the conveyor belt 4 and thus, jam of the paper will occur.

Particularly, where the paper folding apparatus is incorporated in or directly connected to the printer, the paper has no allowance for slackening and therefore, when a different size of paper is used, there is a possibility that the paper stops in the condition d within the folding apparatus depending on its size and in that case, occurrence of jam would be unavoidable.

Referring to FIGS. 8–11, the continuous paper heretofore used, if again folded, may sometimes be piled while being obliquely inclined in the direction of arrow as shown in FIG. 8 or the opposite ends of the paper may be upwardly curled as shown in FIG. 9. In the conventional folding apparatus, the phenomenon of such oblique piling or curling of the paper having the tendency to pile obliquely has been reduced by providing width guide members 12 widthwisely of the paper as shown in FIG. 10 or by providing a half-moonshaped pillow member 13 on the table as shown in FIG. 11, thereby improving the folded condition of the continuous paper. However, during the time that continuous paper of great volume is treated, the uppermost folded surface of the paper rides onto the width guide members 12 or frictionally contacts the width guide members 12 as shown in FIG. 10 or 11 and does not fall downwardly but remains caught by the width guide members, whereby smooth folding cannot take place and jam occurs sometimes as the result of unsatisfactory folding.

The cause of such oblique piling is associated with the direction of fiber of the paper created during the manufacturing step of the paper and accordingly, it would be possible to reduce the occurrence of the phenomenon of oblique piling by adjusting the direction of fiber during the manufacture of the paper. However, it is cumbersome to accurately determine the direction of fiber and further, the continuous paper discharged from a non-impact printer to which is applied the electrophotographic technique using a laser light or CRT tube is subjected to heating and pressure to have a toner image fixed within the printer and therefore, such continuous paper will suffer more remarkably from the phenomena of oblique piling and curling shown in FIGS. 8 and 9. Thus, with the conventional folding apparatus, it has been difficult to fold such continuous paper satisfactorily.

SUMMARY OF THE INVENTION

It is an object of the present invention to eliminate the above-noted inconveniences of the conventional apparatus and to provide a folding apparatus which can accurately fold continuous paper. As the means therefor, suction means for sucking the paper is provided inside of paper conveyor belts.

It is also an object of the present invention to accurately fold paper by a very simple mechanism irrespective of any variation in quality of the paper (ream quantity and strength) and to provide a folding apparatus provided with a detector for detecting that the folded surface of the paper has exceeded the folding level set correspondingly to the quality of the paper (thickness, ream quantity and rigidity or strength of the paper) and a paper supporting table whose vertical movement is controlled by the detection of said detector and wherein, of the six different qualities of paper, #45 and #55 are grouped as thin paper, #70 and #90 are grouped as medium thick paper and #110 and #135 are grouped as thick paper and the distances L1, L2 and L3 from the supply rollers 2 to the folded surface, namely, the detecting position of the detector 7 are varied in accordance with the paper thickness as shown in FIGS. 3–5, whereby curvatures R1, R2 and R3 corresponding to the quality of the paper 1 are obtained.

It is a further object of the present invention to eliminate the possibility of undesirable curl being created in the paper 1 to cause jam. As the means therefor, the vertical movement of the paper supporting table is controlled by discriminating whether or not the printer is in printing operation so that, during the folding operation, the uppermost surface of the paper folded on the paper supporting table is maintained in the vicinity of a predetermined folding position, but when the folding operation is terminated, the paper supporting table is lowered to a stand-by position set below said folding position.

Further, the present invention is a paper folding apparatus for folding continuous paper correspondingly to the folded length thereof and piling the folded paper, having width guide members disposed in opposed relationship with each other on the uppermost surface of the sides of the folded continuous paper for guiding the widthwise inclination of the paper into a predetermined area, pivot shafts provided in the lower portions of said width guide members, swinging means for causing the upper portions of said width guide members to swing about said pivot shafts, vertically moving means for moving said width guide members upwardly or downwardly following the uppermost surface of the folded continuous paper moved upwardly or downwardly correspondingly to the folded length dimension of the continuous paper, and horizontally moving means for parallel-moving at least one of the opposed width guide members leftwardly or rightwardly to a position corresponding to the width dimension of the continuous paper, said swinging means of said width guide members, said vertically moving means and said horizontally moving means being driven independently of one another. The vertical movement of said width guide members and the vertical movement of a folded length controlling guide member moved upwardly or downwardly correspondingly to the folded length dimension of the continuous paper are in synchronism with each other, whereby even when the length of the continuous paper is varied, two or four sides of the paper can always be automatically controlled to thereby prevent the aforementioned oblique piling.

The invention will become more fully apparent from the following detailed description thereof taken in conjunction with the accompanying drawings.

DESCRIPTION OF THE PREFERRED EMBODIMENTS

Figure 12:
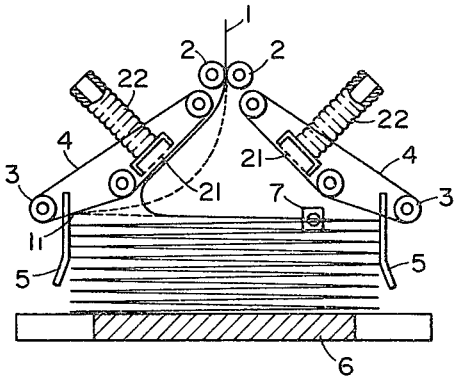
FIGS. 12–15 are schematic cross-sectional views of embodiments of the paper folding apparatus according to the present invention.

Embodiments of the present invention shown in the drawings will hereinafter be described. Referring to FIG. 12, reference numeral 1 designates paper to be folded, reference numeral 21 denotes suction ducts each having an intake opening in proximity to a conveyor belt 4, and reference numeral 22 designates duct hoses each having one end connected to the suction duct 21 and the other end connected to a suction blower, not shown.

At the initial stage of folding, a table 6 on which the paper 1 does not yet rest is moved upwardly until a detector 7 detects the upper surface of the table 6, and then automatically lowered to and stopped at a predetermined position. This stoppage at the lowered position is effected after the table has been lowered from its elevated position for a time electrically set. Or alternatively, the table may be stopped by a detector installed at the lowered stop position.

Subsequently, the paper 1 is passed between a pair of supply rollers 2 and folded into several sheets and set on the table 6, whereafter the suction blower is started to operate.

Upon operation of the suction blower, the air inside the conveyor belts 4 is sucked through suction means comprising the suction ducts 21 and the duct hoses 22, so that the paper 1 is adsorbed to the conveyor belt 4 and a sufficient friction force is imparted thereto. Thus, the paper 1 is conveyed by the conveyor belt 4 and as soon as it strikes against a guide 5, it is folded along a lateral perforation $1_1$.

At the point of time whereat the paper 1 has been folded, it separates from the conveyor belt 4 and assumes a condition as indicated by dotted line and in accordance with the feeding by the supply rollers 2 thereafter, the paper falls down toward the opposite conveyor belt side and adsorbed to and conveyed by that conveyor belt and, when it strikes against a guide 5, it is folded along a lateral perforation $1_1$. Thereafter, such folding operation is repeated. When the uppermost surface of the paper 1 thus folded and piled on the table 6 exceeds the detection level of the detector 7, the table 6 is electrically controlled so as to be automatically lowered by a driving mechanism, not shown, until said uppermost surface comes below the detection level.

As described above, the paper folding apparatus of the present invention conveys the paper by the conveyor belts which adsorbs the paper thereto until the paper is folded and therefore, unlike the conventional apparatus, does not cause the phenomenon of yield or middle fold of the paper but can accurately fold the paper.

The suction duct 21 constituting the suction means may be a cylindrical member provided with a suction opening in the peripheral surface thereof and this may be rotated while being urged against the conveyor belt. Also, the suction means may be one which utilizes electrostatic attraction.

Figure 13:
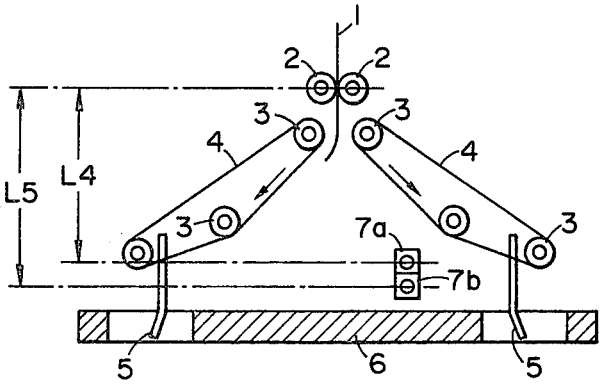
Figure 14:
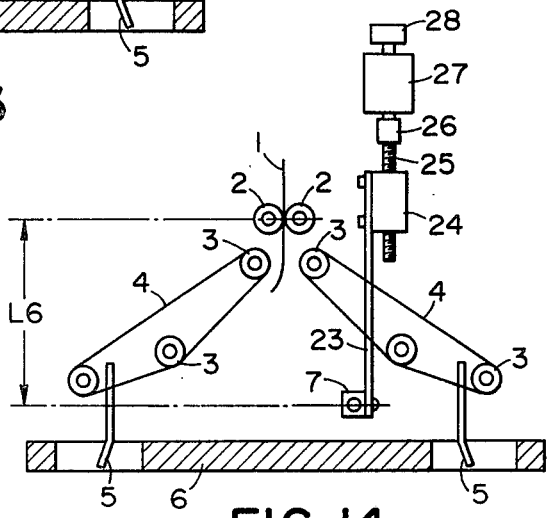

Reference is now had to FIGS. 13–14. FIG. 13 is a cross-sectional view of an embodiment of the present invention in which detectors **7*a* and 7*b* are respectively installed at folding levels corresponding to the paper quality of #45 to #70 and the paper quality of #90 to #135, namely, at positions whereat the distances from the supply rollers 2 to the folded surfaces are L4 and L5. The distance L4 is set to the mean value of L1 and L3 and the distance L5 is set to the means value of L2 and L3, and one of the detector 7*a* or 7*b* is selected correspondingly to the type of quality of the paper. By this construction, the folded surface corresponding to the quality of the paper 1** is set and the jam which would otherwise frequently occur at the initial stage of paper folding or when the amount of piled paper has increased is reduced to ensure stable folding.

FIG. 14 is a cross-sectional view of another embodiment of the present invention in which means is provided for moving the detector 7 to any position corresponding to the quality of the paper. This moving means comprises a support plate 23 of the detector 7 attached to a moving nut, a feeding screw rod 25 threaded into the moving nut 24, and a drive motor 27 operatively associated with the screw rod 25 through a coupling 26. Designated by 28 is a position detector.

When the drive motor 27 is rotated clockwisely or councter-clockwisely, the detector 7 is moved up or down to a distance L6 which is the folding level corresponding to the quality of the paper. Accordingly, simply by entering the type of the quality of the paper used into the apparatus as data, the detector 7 is automatically moved to an optimal folding level position corresponding to the quality of the paper with the aid of the operation of a control circuit within the apparatus, to thereby ensure accurate and good folding of the paper 1 and sharply reduce the jam.

As described above, the detector for detecting the folded surface of the paper is installed at the folding level corresponding to the quality of the paper, whereby the folded surface is maintained in an optimal condition corresponding to the quality of the paper, thus enabling accurate and stable folding.

Figure 15:
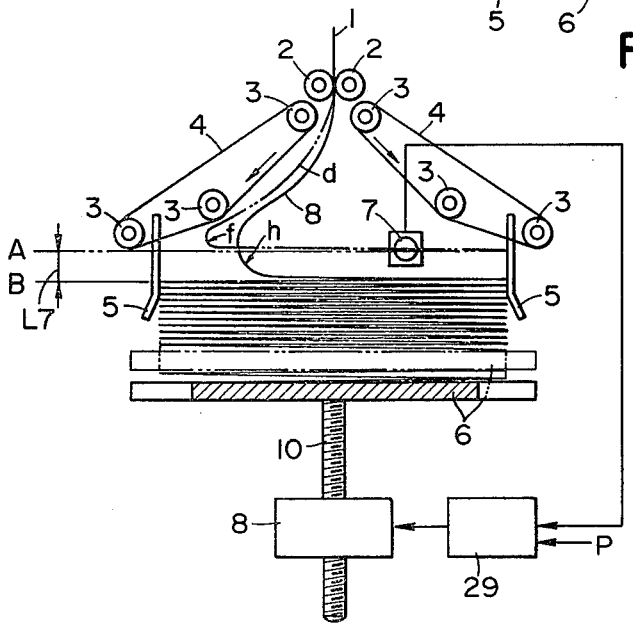

Reference is now had to FIG. 15 to describe another embodiment of the present invention. Reference numerals 1–8 designate members similar to those of the aforedescribed conventional apparatus. Designated by 29 is a control circuit for controlling the lift mechanism 8 on the basis of the output of the detector 7 and the output P of a central processing unit (not shown) which has discriminated whether or not the printer is in printing operation. When the folding operation has been stopped, the control circuit 29 drives the lift mechanism 8 for a predetermined time to cause a screw rod 10 at the center of the underside of the paper supporting table 6 to lower the table 6 by a distance L7 from a predetermined paper folding position (level A) whereat the detector 7 is installed to a stand-by position (level B).

Now, when a predetermined time, $t_1$ seconds, has elapsed after the uppermost surface of the paper 1 folded and piled on the table 6 goes beyond the detection level A of the detector 7, namely, the predetermined paper folding position, in accordance with the repetition of the folding operation, the control circuit 29 drives the lift mechanism 8 at a first speed $v_1$ for a predetermined time, $t_2$ seconds, to thereby lower the table 6 at a low speed so that the paper does not jam, and return the uppermost surface of the paper 1 to the predetermined paper folding position. When this uppermost surface is piled again beyond the paper folding position, said operation is repeated to ensure the uppermost surface to be always maintained at the folding position.

On the other hand, if the folding apparatus stops operating when the paper 1 is in dots-and-dash line condition d, the control circuit 29 detects this stoppage and drives the lift mechanism 8 at a second speed $v_2$ for a predetermined time, $t_3$ seconds to lower the table 6 at high speed by a distance L until the uppermost surface of the folded and piled paper 1 comes from the level A to the level B, namely, in order to prevent curling of the paper. Therefore, the paper 1 is cooled after it has changed from the condition d of curvature f to the condition g of curvature h and thus, it does not create the undesirable strong curl as has been experienced in the aforementioned conventional apparatus.

When the printer again starts its printing operation in the above-described stopped condition, the control circuit 29 first detects this start and drives the lift mechanism 8 at a third speed $v_3$ (which may be equal to the speed $v_2$) for a predetermined time, $t_4$ seconds, to move the table 6 upwardly at high speed by a distance L7 until the uppermost surface of the folded and piled paper 1 comes from the level B to the level A, namely, until it comes to the original set position in a short time. This upward movement of the table is terminated immediately before the folding is started.

According to the paper folding apparatus of the present embodiment, as described above, when the folding operation has been stopped, the uppermost surface of the folded and piled paper is retracted to the stand-by position and therefore, the paper does not create undesirable curl. Accordingly, even if the folding is restarted, no jam occurs immediately thereafter and good folding can be obtained.

In the embodiment, the above-mentioned stand-by position is set by the driving time of the table 6, whereas this is not restrictive but a detector for detecting the uppermost surface of the piled paper may be installed at the stand-by position and the stand-by position may be set by combining such detector with the detector installed at the folding position.

The invention will be described in detail with respect to still another embodiment thereof.

Figure 1:
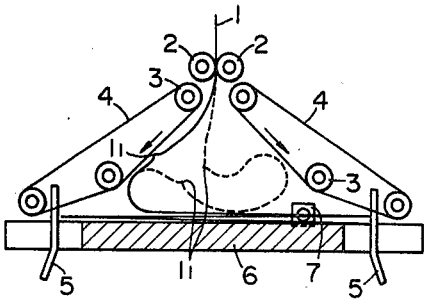
FIG. 1 PRIOR ART
FIGS. 1–7 are schematic cross-sectional views of the paper folding apparatus according to the prior art.
Figure 2:
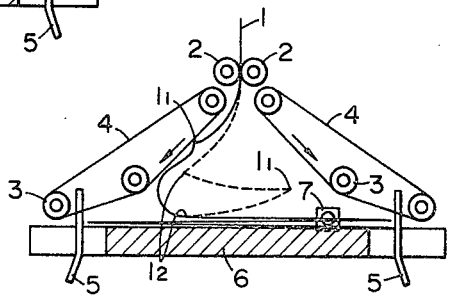
FIG. 2 PRIOR ART
Figure 3:
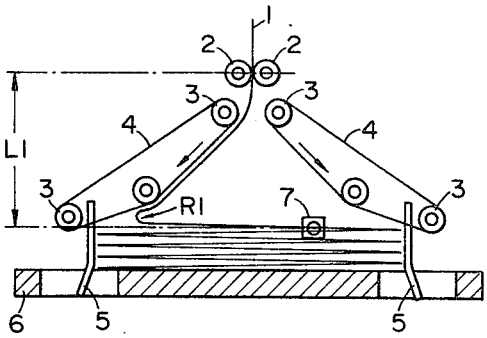
FIG. 3 PRIOR ART
Figure 4:
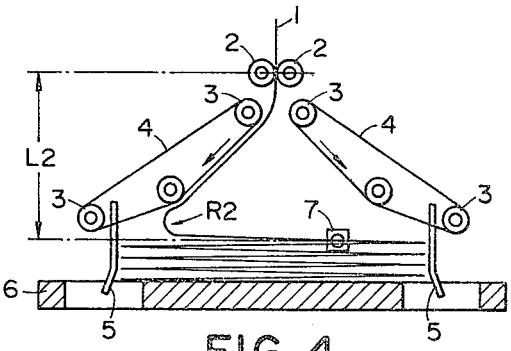
FIG. 4 PRIOR ART
Figure 5:
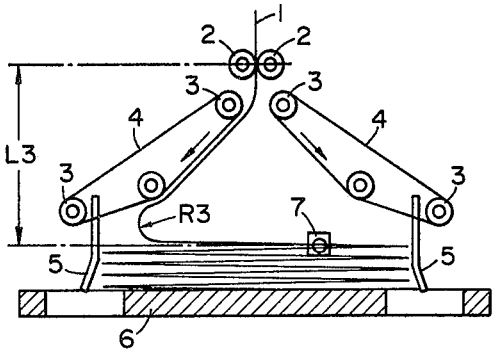
FIG. 5 PRIOR ART
Figure 6:
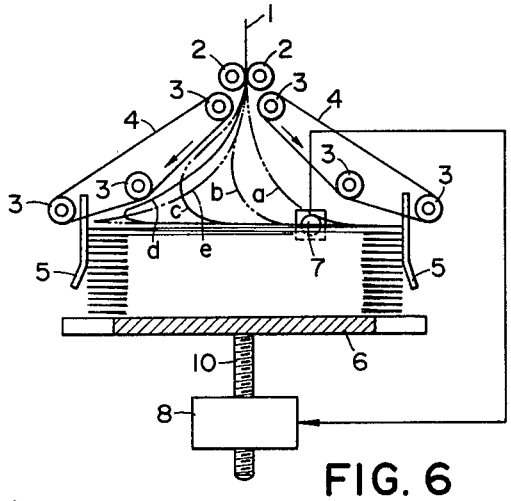
FIG. 6 PRIOR ART
Figure 7:
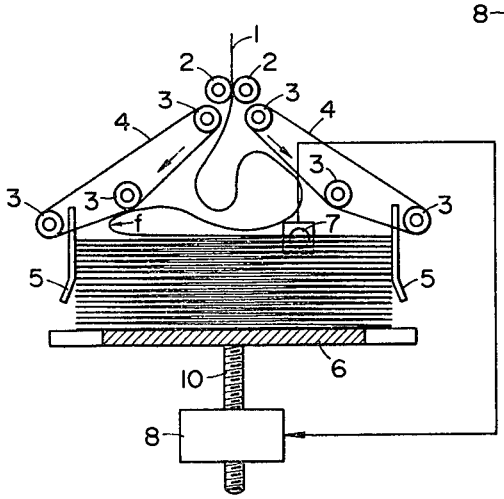
FIG. 7 PRIOR ART
Figure 8:
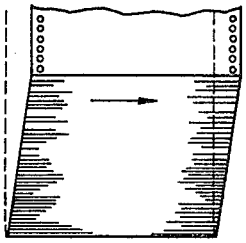
FIG. 8 PRIOR ART
FIGS. 8–11 illustrate the conditions of paper folded by the paper folding apparatus according to the prior art.
Figure 9:
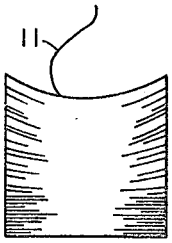
FIG. 9 PRIOR ART
Figure 10:
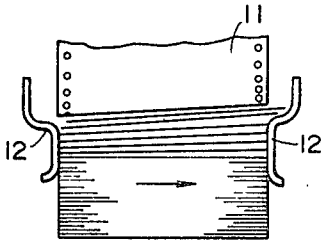
FIG. 10 PRIOR ART
Figure 11:
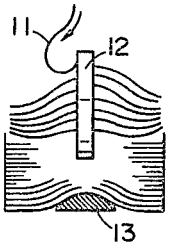
FIG. 11 PRIOR ART
Figure 16:
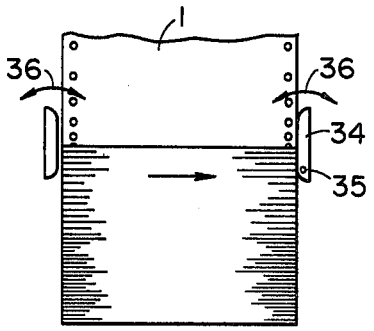
FIGS. 16 and 17 are a front view and a side view, respectively, schematically showing an embodiment of the present invention.
Figure 17:
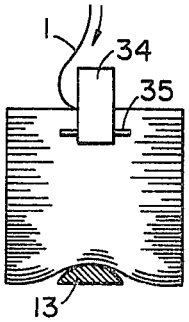

In FIGS. 16 and 17, reference numeral 34 designates the width guide member of the present invention which is wider than those shown in FIGS. 10 and 11. This guide member is for preventing the continuous paper 1 from being piled obliquely with respect to its widthwise direction. This guide member is pivotable in the direction of arrow 36 about a pivot shaft to minimize its frictional contact with the paper 1 and put the folded paper 1 in order while guiding the paper downwardly without piling it obliquely. As the result, the paper folding operation becomes smooth and the uppermost surface of the folded paper can always be maintained flat and thus, an accurate and good folding characteristic can be obtained, thereby enabling treatment of a great quantity of continuous paper.

Figure 18:
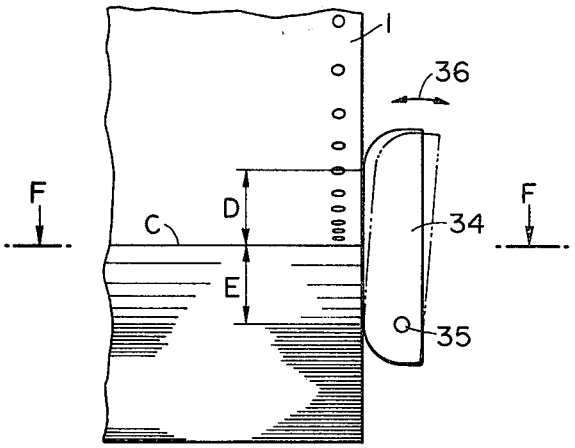
FIG. 18 is a fragmentary enlarged view showing the neighborhood of a width guide member.
Figure 19:
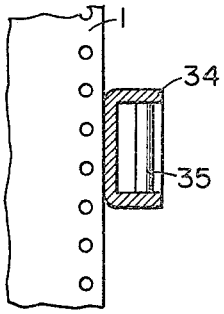
FIG. 19 is a cross-sectional view taken along line F—F of FIG. 18.

FIG. 18 is an enlarged view of the portion shown in FIGS. 16 and 17, the level C is the uppermost surface of the folded paper 1. The width guide member 34 swings about the pivot shaft 35 between a dots-and-dash line position and a solid-line position and in an area indicated by D, it puts in order the paper 1 being folded while avoiding the frictional contact with the incoming paper and in an area indicated by E, it guides the folded paper downwardly without putting it into disorder. FIG. 19 is a cross-sectional view taken on the uppermost level C of the folded paper and along the line F—F of FIG. 18. The widthwise ends of the width guide member 34 are rounded with a predetermined radius so as not to interfere with the incoming paper 1 in the area D of FIG. 18. By causing the upper portion of the width guide member 34 to be so vibrated also in a direction away from the paper, the phenomenon of the paper being caught by this guide member can be better prevented.

Figure 20:
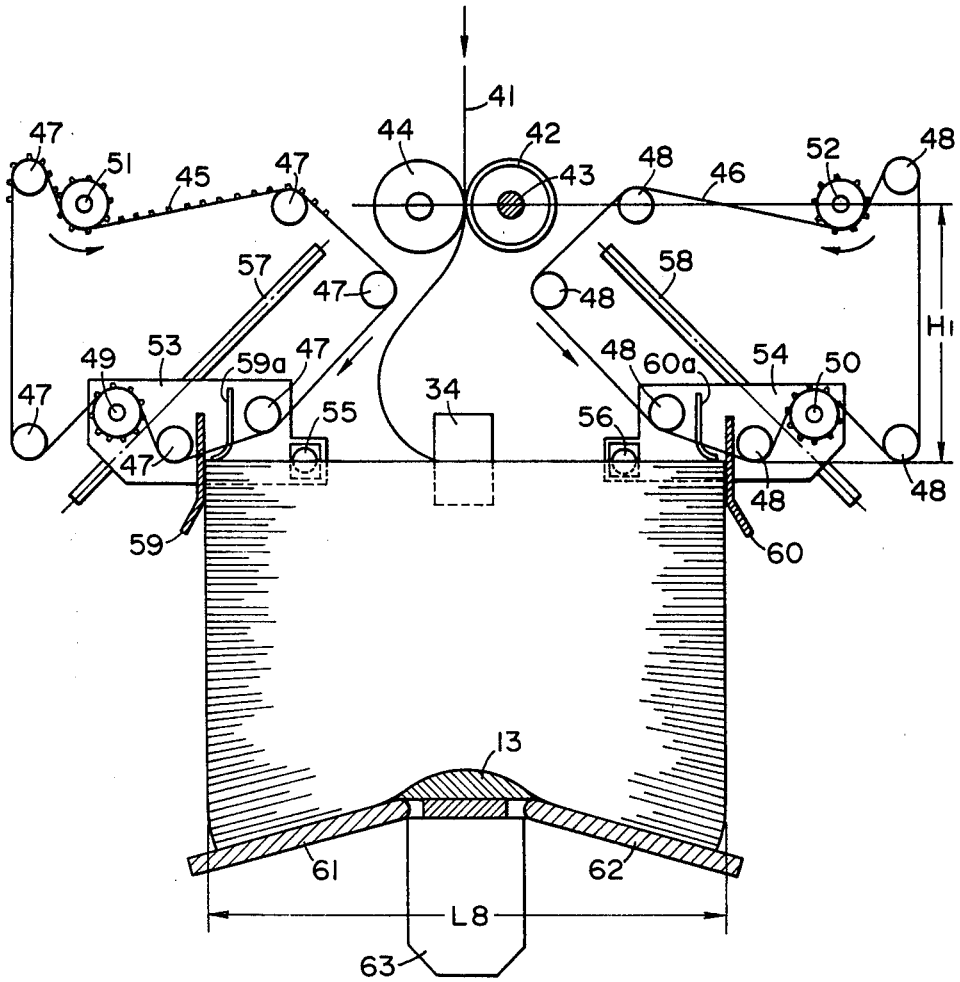
FIGS. 20 and 21 are cross-sectional views of one embodiment of the present invention.
Figure 21:
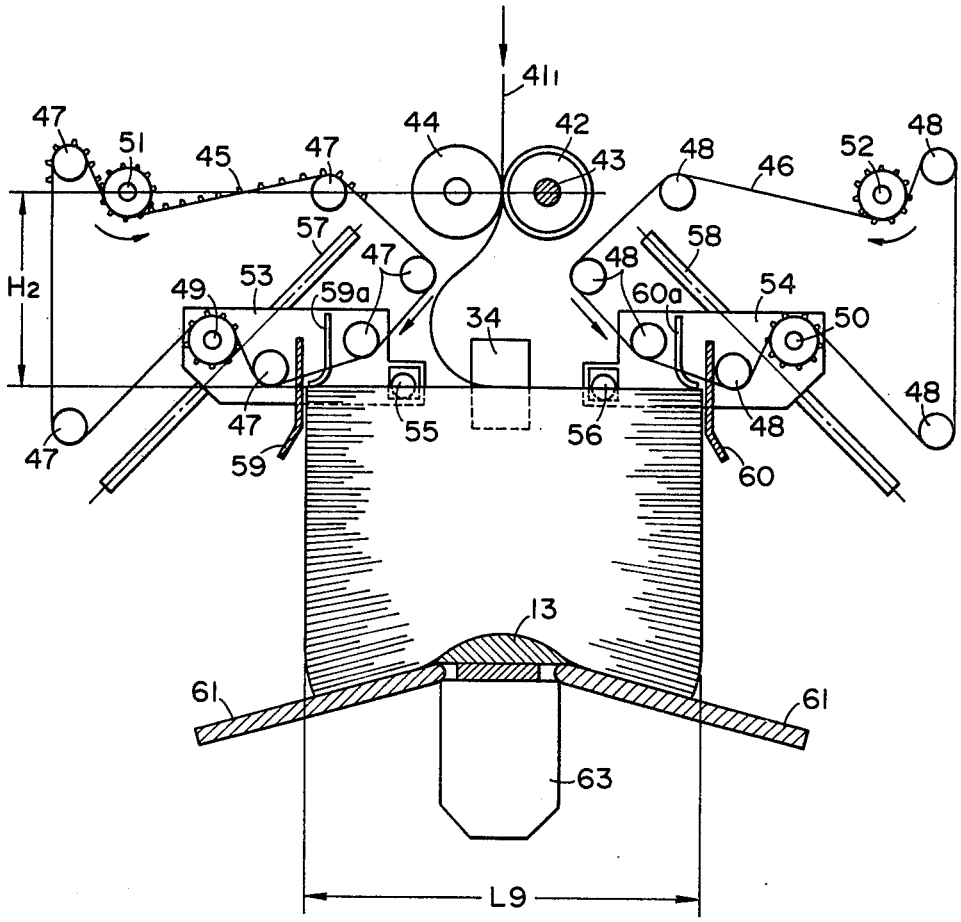

FIGS. 20 and 21 are front views showing an example of the folding apparatus in which the arrangement of the folding mechanism is varied correspondingly to the folded length of the paper, and illustrate the condition in which the width guide member is installed. In FIG. 20, continuous paper having a great folded length is set, and in FIG. 21, continuous paper having a folded length shorter than that of FIG. 20 is set. These Figures include continuous paper 41 having a folded length L8, a feed roller 42 having a drive shaft 43, a back-up roller 44 urged against the feed roller 42, fold belts (toothed belts) 45, 46 for frictionally conveying the paper, pulleys 47, 48, 49, 50 over which the fold belts are passed, drive pulleys 51 52 for driving the fold belts in the direction of arrow, movable side plates 53, 54 parallel-movable correspondingly to the folded length by an unshown driving mechanism, folded paper uppermost level detecting means 55, 56 such as photoelectric switches attached to the movable side plates 53, 54, guide shafts 57, 58 for parallel-moving the movable side plates 53, 54, length guides 59, 60 for controlling the folded length of the paper, tables 61, 62 having the opposite ends thereof adapted to be downwardly closed as the paper is piled thereon, and a support bed 63 for the tables 61, 62.

In FIG. 20, the movable side plates 53 and 54 are set at predetermined positions correspondingly to the folded length L8 of the paper 41, and the uppermost surface of the folded paper lies at a distance H1 from the point of contact between the feed roller 42 and the back-up roller 43. Likewise, the width guide 34 is installed at a position whereat the relation between the level C and areas D, E shown in FIG. 18 is obtained. The paper 41 passed and fed between the feed roller 42 and the back-up roller 43 is folded by the frictional conveying action of the fold belts 44, 45 and compressed by pressure plates 59*a*, 60*a* vertically vibrated by an unshown mechanism, and piled on the tables 61, 62. When the piled paper is increased and comes to be positioned beyond the fold level detecting means 55, 56 installed at the left and right, the support bed 63 of the tables 61, 62 drives an unshown lift mechanism and automatically lowers by a predetermined distance. During the time that this folding operation is taking place, the width guide 34 repeats its swinging movement shown in FIG. 18 and continues to put the folded paper in order so that the folded paper is piled obliquely.

Likewise, in FIG. 21, the movable side plates 53 and 54 are set correspondingly to the folded length L9 of the paper $41_1$ and at positions whereat the uppermost folded surface of the paper lies at a distance H2 from the rollers 42, 44, and the width guide member 34 is also moved up to the same position. Accordingly, in the folding apparatus of the present embodiment, moving means for moving the width guide member 34 up and down corresponding to the folded length of the paper is required.

Figure 22:
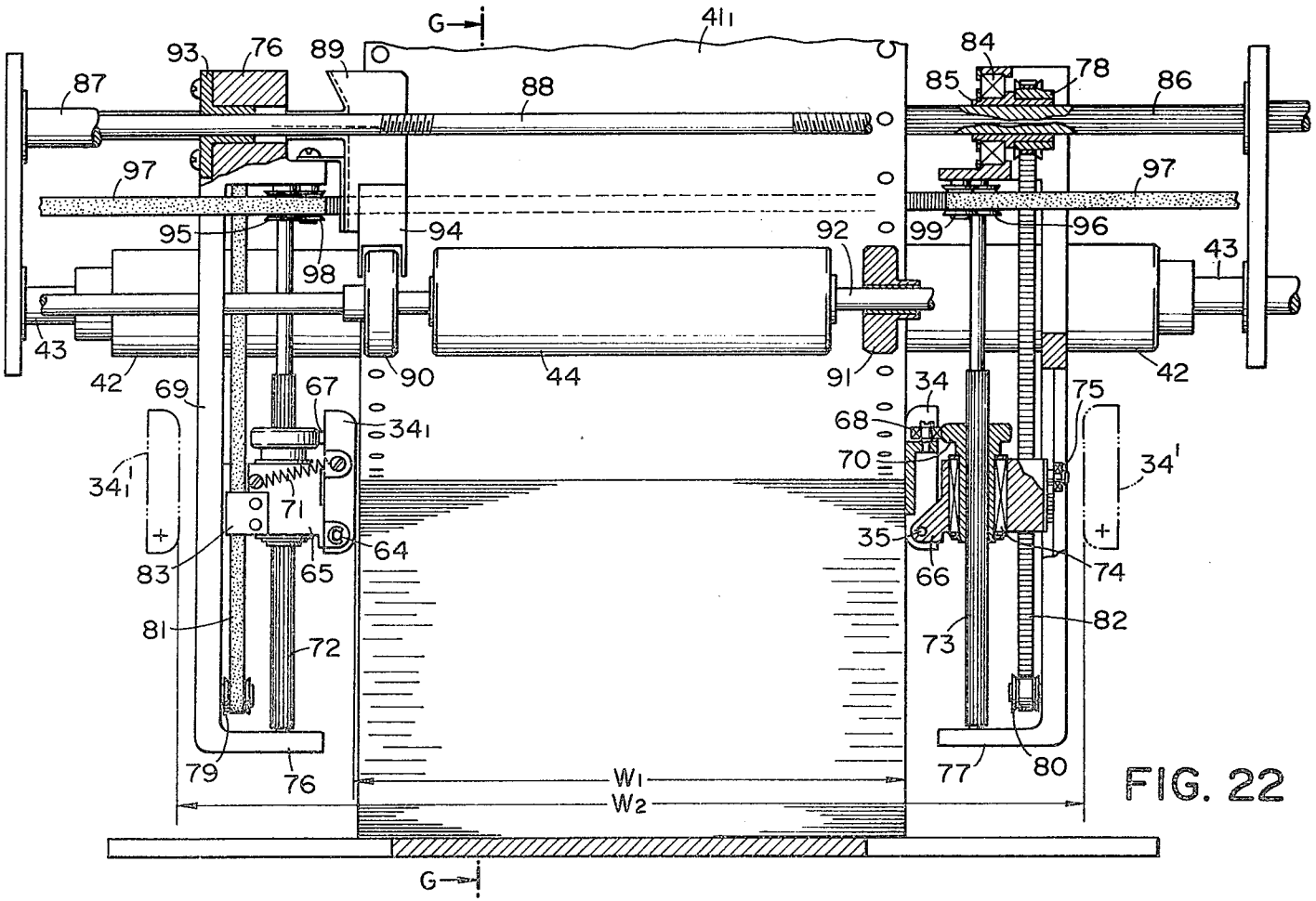
FIG. 22 is a front view thereof.

FIG. 22 is a front view of the apparatus as seen from the widthwise direction of the continuous paper, and shows the construction of the driving portion for the width guide member mechanism. The width guide members 34 and $34_1$ are secured to width guide blocks 65 and 66 for swinging movement about pivot shafts 35 and 36 while, on the other hand, main bearings 67 and 68 are caused to bear against eccentric cams 69 and 70 by the action of tension springs 71. The eccentric cams 69 and 70 are provided with spline teeth in the apertures thereof, and these spline teeth are fitted to spline shafts 72 and 73 while, on the other hand, they are rotatably supported by roller bearings 74 forced into the width guide blocks. The width guide blocks 65 and 66 are guided with ball bearings 75 fitted in guided grooves provided in width guide bases 76 and 77 and further, the guide blocks 65 and 66 are attached to toothed belts 81 and 82 passed over and between toothed pulleys 78 and idlers 79, 80, by fittings 83. The toothed pulleys 78 are fixed to spline wheel bosses 85 rotatably mounted on the width guide bases 76 and 77 with ball bearings 84 interposed therebetween.

Thus, when the spline shafts 72 and 73 are rotated, the eccentric cams 69 and 70 are rotated to force out the ball bearings 67 and 68 against the force of the springs 71 and therefore, the width guide members 34 and $34_1$ are vibrated back and forth about the pivot shafts 35 and 64 with respect to the paper $41_1$. On the other hand, when spline shaft 86 fitted to the spline wheel boss 85 is rotated, the spline wheel boss 85 and the toothed pulleys 78 are rotated and by the amount of rotation thereof, the width guide blocks 65 and 66 fixed to the toothed belts 81 and 82 are moved up or down to an arbitrary position.

Figure 23:
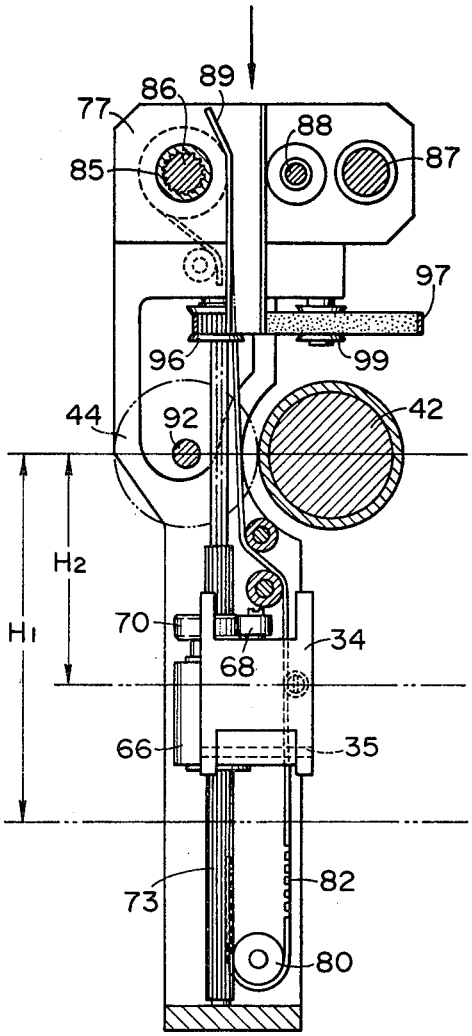
FIG. 23 is a cross-sectional view taken along line G—G of FIG. 22.

Further, as shown in FIG. 22, the width guide bases 76 and 77 are supported by three shafts, namely, the spline shaft 86, the width guide shaft 87 and a feed screw shaft 88 having a right-handed thread and a left-handed thread provided thereon symmetrically with respect to the center of the shaft. Such supported condition is also apparent from FIG. 23 which is a cross-section on the line G—G of FIG. 22 with the paper $41_1$ neglected. Reference numeral 89 designates a paper guide plate for the paper $41_1$, and reference numeral 90 and 91 denote auxiliary rollers mounted on the support shaft 92 of the back-up roller 44. When the feed screw shaft 88 is rotated, the width guide bases 79 are symmetrically moved through a feed nut 93 and at that time, the position of the auxiliary roller 90 is displaced on the shaft 92 by an arm 94 fixed to the paper guide plate 89. The auxiliary rollers 90 and 91 are urged against only the central portion of the paper because the back-up roller 44 escapes from the width guide bases 76 and 77 and therefore, when wide paper is to be folded, they serve to prevent the opposite ends of the paper from separating from the feed roller 42 and floating up.

Figure 24:
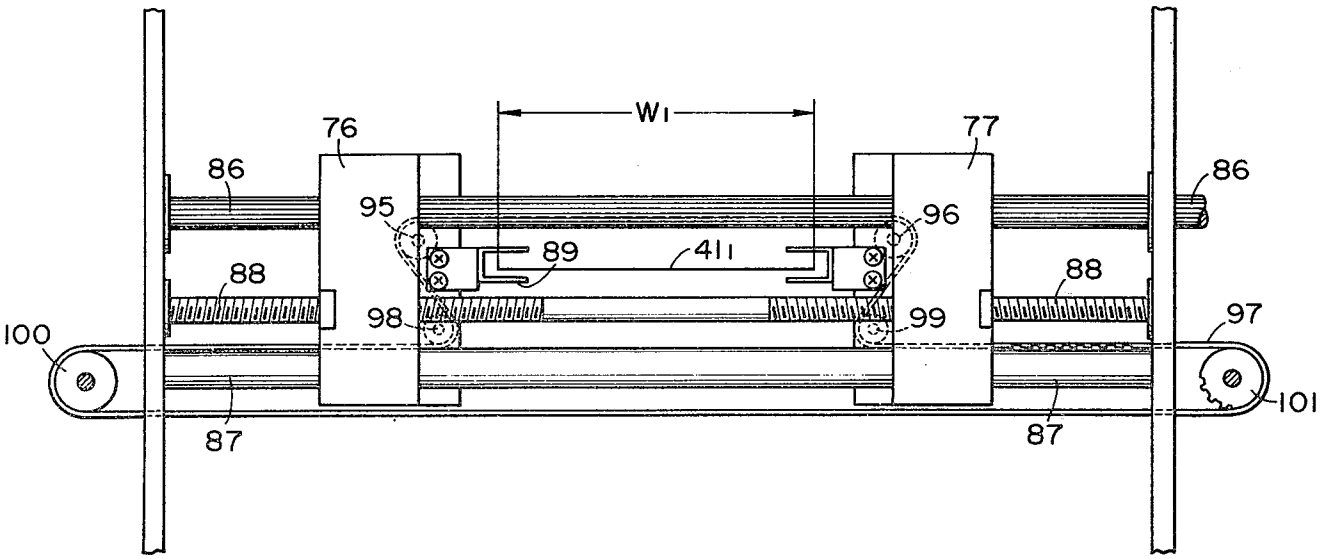
FIG. 24 is a plan view corresponding to FIG. 22.

The spline shafts 72 and 73 have toothed pulleys 95 and 96 fixed to the upper ends thereof, and a toothed belt 97 is passed over the toothed pulleys 95 and 96. In FIG. 24 which is a top plan view of the width guide mechanism set to the paper width W1, reference numerals 98 and 99 designate idler pulleys, and reference numerals 100 and 101 denote drive pulleys. The toothed belt 97 is passed over the toothed pulleys 95 and 96 so that the width guide bases 76 and 77 are movable to the left and right. That is, irrespective of the positions of the width guide bases 76 and 77, the toothed belt 97 is moved round by rotating the drive pulleys 100 and 101 and as the result, the toothed pulleys 95, 96, spline shafts 72, 73 and eccentric cams 69, 70 are rotated and the width guide members 34 and $34_1$ swing through the agency of the ball bearings 67 and 68.

With the above-described construction, even when the length of continuous paper used with the present apparatus is changed, the width guide members for preventing oblique piling of the paper can be moved up and down correspondingly to the uppermost surface of the folded paper which is variable in accordance with the length of the paper, and further can be vibrated with respect to the paper independently of the vertical position of the width guide members. Also, the vibration, vertical movement and parallel movement relative to the width of the paper can be effected independently of one another and therefore, only the vibrating movement can be easily varied depending on the physical characteristic and conveyance speed of the paper.

Description will now be made of the relation between the mechanism for vertically and horizontally moving the width guide members 34, $34_1$ and the movable side plates 53, 54 of FIG. 21. The side plates 53 and 54 are guided up and down by the guide shafts 57 and 58 and this movement, like the movement of the bases 76 and 77 of FIG. 22, is realized by a construction in which the feed nuts of the side plates 53 and 54 are fitted onto threaded shafts, not shown. Thus, the side plates 53 and 54 may be vertically moved a predetermined amount by rotating the threaded shafts by the same amount. By rotating the spline shaft 86 of FIG. 22 in relation to the amount of rotation of the threaded shafts for the vertical movement of the side plates, the levels of the side plates and width guide members can be fixed at predetermined vertical positions.

The embodiments of the present invention have shown a construction in which when use is made of paper of a different width dimension, the width guide members are symmetrically moved from the central position at a time, whereas this is not restrictive but, depending on the convenience of the conveyance path of the paper, it is also possible that one of the width guide members is fixed while only the other width guide member is made movable. As regards the amounts of movement of the side plates and width guide members resulting from a change in the width of the paper or the folded length, it is also possible to design these members such that when the paper used is of the standard type, each member is moved a predetermined amount by a designated signal.

What I claim is:

1. A paper folding apparatus for folding continuous paper correspondingly to the folded length thereof and piling the folded paper, having width guide members disposed in opposed relationship with each other on the uppermost surface of the sides of the folded continuous paper for guiding the widthwise inclination of the paper into a predetermined area, pivot shafts provided in the lower portions of said width guide members, swinging means for causing the upper portions of said width guide members to swing about said pivot shafts, vertically moving means for moving said width guide members upwardly or downwardly following the uppermost surface of the folded continuous paper moved upwardly or downwardly correspondingly to the folded width dimension of the continuous paper, and horizontally moving means for parallel-moving at least one of the opposed width guide members leftwardly or rightwardly to a position corresponding to the width dimension of the continuous paper, said swinging means of said width guide members, said vertically moving means and said horizontally moving means being driven independently of one another.

2. A paper folding apparatus according to claim 1, wherein the vertical movement of said width guide members and the vertical movement of a folded width controlling guide member moved upwardly or downwardly correspondingly to the folded width dimension of the continuous paper are in synchronism with each other.

* * * * *